US011933538B2

(12) United States Patent
Kromer et al.

(10) Patent No.: US 11,933,538 B2
(45) Date of Patent: Mar. 19, 2024

(54) SYSTEM AND METHOD FOR RECOVERY OF NITROGEN, ARGON, AND OXYGEN IN MODERATE PRESSURE CRYOGENIC AIR SEPARATION UNIT

(71) Applicants: Brian R. Kromer, Buffalo, NY (US); Neil M. Prosser, Lockport, NY (US)

(72) Inventors: Brian R. Kromer, Buffalo, NY (US); Neil M. Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 323 days.

(21) Appl. No.: 17/229,919

(22) Filed: Apr. 14, 2021

(65) Prior Publication Data

US 2021/0348842 A1 Nov. 11, 2021

Related U.S. Application Data

(60) Provisional application No. 63/022,611, filed on May 11, 2020.

(51) Int. Cl.
*F25J 3/04* (2006.01)
*F25J 3/02* (2006.01)

(52) U.S. Cl.
CPC ..... *F25J 3/04054* (2013.01); *F25J 3/0295* (2013.01); *F25J 3/0406* (2013.01);
(Continued)

(58) Field of Classification Search
CPC .... F25J 3/04303; F25J 3/04054; F25J 3/0295; F25J 3/0406; F25J 3/04066;
(Continued)

(56) References Cited

U.S. PATENT DOCUMENTS 3,469,271 A * 9/1969 Kitamura ..... F25J 3/04818 62/646
4,575,388 A 3/1986 Okada
(Continued)

FOREIGN PATENT DOCUMENTS

CN 106642995 B 5/2019
DE 19855485 A1 6/1999
(Continued)

OTHER PUBLICATIONS

Harry Cheung; "Moderate-pressure cryogenic air separation process"; Gas Separation & Purification; Mar. 1991; vol. 5; pp. 25-28.
(Continued)

*Primary Examiner* — Miguel A Diaz
*Assistant Examiner* — Ibrahim A. Michael Adeniji
(74) *Attorney, Agent, or Firm* — Robert J. Hampsch

(57) ABSTRACT

A moderate pressure nitrogen and argon producing cryogenic air separation unit is provided that includes a three distillation column system and turbine air stream bypass arrangement or circuit. The turbine air stream bypass arrangement or circuit is configured to improve argon and nitrogen recoveries in select operating modes by optionally diverting a portion of the turbine air stream to a nitrogen waste stream circuit drawn from the lower pressure column of the cryogenic air separation unit such that the diverted portion of the turbine air stream bypasses the distillation column system.

8 Claims, 3 Drawing Sheets

(52) U.S. Cl.
CPC ..... *F25J 3/04066* (2013.01); *F25J 3/04072* (2013.01); *F25J 3/04127* (2013.01); *F25J 3/04212* (2013.01); *F25J 3/04242* (2013.01); *F25J 3/04454* (2013.01); *F25J 2235/50* (2013.01); *F25J 2260/20* (2013.01)

(58) Field of Classification Search
CPC .. F25J 3/04072; F25J 3/04127; F25J 3/04212; F25J 3/04242; F25J 3/04454; F25J 2235/50; F25J 2260/20; F25J 3/0426; F25J 2200/20; F25J 2200/94; F25J 2210/42; F25J 2230/42; F25J 2230/50; F25J 2245/40; F25J 2245/42; F25J 3/0486; F25J 3/0409; F25J 3/04181; F25J 3/04672; F25J 3/04727; F25J 2250/04; F25J 3/04412; F25J 2205/60; F25J 2245/50
See application file for complete search history.

(56) References Cited

U.S. PATENT DOCUMENTS

| | | | |
|---|---|---|---|
| 4,822,395 | A | 4/1989 | Cheung |
| 5,069,698 | A | 12/1991 | Cheung |
| 5,255,522 | A | 10/1993 | Agrawal et al. |
| 5,305,611 | A | 4/1994 | Howard |
| 5,355,681 | A | 10/1994 | Xu |
| 5,440,884 | A | 8/1995 | Bonaquist |
| 5,469,710 | A | 11/1995 | Howard |
| 5,722,259 | A | 3/1998 | Sorensen |
| 5,802,873 | A | 9/1998 | Howard |
| 5,956,973 | A | 9/1999 | Herron |
| 6,106,593 | A | 8/2000 | Golden et al. |
| 6,173,586 | B1 | 1/2001 | Bonaquist |
| 6,397,632 | B1 | 6/2002 | Meagher |
| 6,694,775 | B1 | 2/2004 | Higginbotham et al. |
| 10,663,222 | B2 | 5/2020 | Kromer et al. |
| 10,663,223 | B2 | 5/2020 | Handley et al. |
| 10,663,224 | B2 | 5/2020 | Prosser et al. |
| 10,816,263 | B2 | 10/2020 | Prosser et al. |
| 2005/0138960 | A1* | 6/2005 | Prosser ..... F25J 3/04393 62/643 |
| 2007/0209389 | A1 | 9/2007 | Prosser |
| 2008/0000352 | A1 | 1/2008 | Howard |
| 2008/0223077 | A1 | 9/2008 | Prosser |
| 2009/0277220 | A1 | 11/2009 | Howard |
| 2010/0037656 | A1 | 2/2010 | Prosser |
| 2012/0011887 | A1 | 1/2012 | Nakamura et al. |
| 2012/0036892 | A1 | 2/2012 | Prosser |
| 2013/0312427 | A1 | 11/2013 | Hashi et al. |
| 2014/0245782 | A1 | 9/2014 | Howard |
| 2016/0025408 | A1 | 1/2016 | Xu |
| 2017/0030638 | A1 | 2/2017 | Prosser et al. |
| 2017/0030640 | A1 | 2/2017 | Du et al. |
| 2017/0167788 | A1 | 6/2017 | Pierre, Jr |
| 2018/0073804 | A1 | 3/2018 | Allam |
| 2019/0331416 | A1 | 10/2019 | Prosser et al. |
| 2019/0331418 | A1 | 10/2019 | Prosser et al. |
| 2020/0054985 | A1* | 2/2020 | Parsnick ..... F25J 3/04212 |

FOREIGN PATENT DOCUMENTS

| | | | |
|---|---|---|---|
| DE | 10232430 | A1 | 1/2004 |
| DE | 20319823 | U1 | 4/2004 |
| EP | 0454327 | A1 | 10/1991 |
| EP | 0576314 | A1 | 12/1993 |
| JP | S54116385 | A | 9/1979 |
| JP | S6179978 | A | 4/1986 |
| JP | S61243273 | A | 10/1986 |
| WO | 87/006684 | A1 | 11/1987 |
| WO | 2013/167817 | A2 | 11/2013 |

OTHER PUBLICATIONS

Roland Michely; "Luftzerlegungsanlagen im Parallelbetrieb", Linde Berichte Aus Technik & Wissenschaft, No. 43, Jun. 1, 1978 (Jun. 1, 1978), pp. 39-44, XP001253417, p. 41, col. 2, paragraph 3; figures 2-4, p. 43, col. 2, lines 3-5.

H. Springmann; "Moeglichkeiten zur Energieeinsparung", Linde-Symposium, Luftzerlegungsanlagen, Oct. 15, 1980 (Oct. 15, 1980), pp. 1-16, XP055392504, p. 14, paragraph 2—p. 15, paragraph 1; figure 12.

Hashimoto Tamotsu; "New air separation plant utilizing off peak power", Kobelco Technology Review, Kobe Steel, Kobe, JP, No. 15, Oct. 1, 1992 (Oct. 1, 1992), p. 71, XP009187816, ISSN: 0913-4794, paragraph [0001]—paragraph [0003]; figure 1; table 1.

* cited by examiner

SYSTEM AND METHOD FOR RECOVERY OF NITROGEN, ARGON, AND OXYGEN IN MODERATE PRESSURE CRYOGENIC AIR SEPARATION UNIT

CROSS REFERENCE TO RELATED APPLICATION

This application claims the benefit of and priority to U.S. provisional patent application Ser. No. 63/022,611 filed May 11, 2020 the disclosure of which is incorporated by reference.

TECHNICAL FIELD

The present invention relates to the enhanced recovery of liquid oxygen from a nitrogen producing cryogenic air separation unit, and more particularly, to enhanced recovery of liquid oxygen from a moderate pressure cryogenic air separation unit having high argon and nitrogen recoveries.

BACKGROUND

Air separation plants targeted for production of nitrogen that operate at moderate pressures (i.e. pressures that are higher than conventional cryogenic air separation unit pressures) have existed for some time. In conventional air separation units, if nitrogen at moderate pressure is desired, the lower pressure column could be operated at a pressure above that of conventional air separation units. However, such operation would typically result in a significant decrease in argon recovery as much of the argon would be lost in the oxygen rich or nitrogen rich streams rather than being passed to the argon column.

To increase the argon recovery in such moderate pressure, nitrogen producing air separation units, a modified air separation cycle was developed in the late 1980s and early 1990s. See, for example, the technical publication Cheung, Moderate Pressure Cryogenic Air Separation Process, Gas Separation & Purification, Vol 5, March 1991 and U.S. Pat. No. 4,822,395 (Cheung). In these prior art documents, a nitrogen and argon producing air separation plant with somewhat high argon recovery is disclosed. The modified air separation cycle involves operating the higher pressure column at a nominal pressure of preferably between about 80 to 150 psia, while the lower pressure column preferably operates at a nominal pressure of about 20 to 45 psia, and the argon column would also preferably operate at a nominal pressure of about 20 to 45 psia. Recovery of high purity nitrogen (i.e. >99.98% purity) at moderate pressure of about 20 to 45 psia is roughly 94%. High argon recovery at 97.3% purity and pressures of between about 20 to 45 psia is generally above 90% but is capped at 93%.

In the above described prior art moderate pressure air separation cycles, high purity liquid oxygen from the sump of the lower pressure column is used as the refrigerant in the argon condenser rather than kettle liquid. However, when using the high purity liquid oxygen from the sump of the lower pressure column, the argon column needs to operate at higher pressures than conventional argon columns in order to achieve the required temperature difference in the argon condenser. The increase in pressure of the argon column requires the lower pressure column and higher pressure column to also operate at moderate pressures, or pressures higher than conventional cryogenic air separation units.

The use of high purity liquid oxygen in the argon condenser also means that the large kettle vapor stream that normally feeds the lower pressure column is avoided, which yields a marked improvement in recovery. As a result, high recoveries of nitrogen, argon, and oxygen are possible with this moderate pressure air separation cycle, even though the elevated pressures would otherwise penalize recovery compared to conventional air separation cycles. The moderate pressure operation of the air separation unit is generally beneficial for nitrogen production, as it means the nitrogen compression is less power intensive and the nitrogen compressor will tend to be less expensive than nitrogen compressors of conventional systems.

Even though the air separation unit in the Cheung publication and U.S. Pat. No. 4,822,395 provides a high purity oxygen vapor exiting the argon condenser, this oxygen stream is not used as oxygen product because the stream exits the process at too low pressure (e.g. 18 psia) and would often require an oxygen compressor to deliver oxygen product to a customer at sufficient pressure. In some regions, use of oxygen compressors are generally unacceptable due to safety and cost considerations. When used, oxygen compressors are very expensive and usually require more complex engineered safety systems, both of which adversely impacts the capital cost and operating costs of the air separation unit.

U.S. patent application Ser. Nos. 15/962,205; 15/962,245; and 15/962,297 disclose new air separation cycles for moderate pressure cryogenic air separation units that improve argon recovery and provides for limited oxygen recovery without the need for oxygen compressors. However, these new cryogenic air separation cycles are operationally limited in off-design operating modes such as start-up, high liquid make, low argon make, higher purity nitrogen make, etc. due to the need to draw a waste nitrogen stream from the lower pressure column, which in turn adversely impacts the nitrogen recovery, the argon recovery or both.

What is needed are further improved moderate pressure cryogenic air separation units and moderate pressure cryogenic air separation cycles capable of operating in off-design operating modes without significantly reducing the nitrogen recovery and/or argon recovery compared to nitrogen and argon recoveries in the same cryogenic air separation unit under normal operating modes.

SUMMARY OF THE INVENTION

The present invention may be characterized as a nitrogen and argon producing cryogenic air separation unit comprising: (i) a main air compression system configured to receive an incoming feed air stream and produce a compressed air stream; (ii) an adsorption based pre-purifier unit configured for removing water vapor, carbon dioxide, nitrous oxide, and hydrocarbons from the compressed air stream and produce a compressed and purified air stream, wherein the compressed and purified air stream is split into at least a first part of the compressed and purified air stream and a second part of the compressed and purified air stream; (iii) a main heat exchange system configured to cool the first part of the compressed and purified air stream and to partially cool the second part of the compressed and purified air stream; and (iv) a turboexpander arrangement configured to expand the partially cooled second part of the compressed and purified air stream to form an exhaust stream; (v) a distillation column system having a higher pressure column and a lower pressure column linked in a heat transfer relationship via a condenser-reboiler and configured to separate the cooled first part of the compressed and purified air stream and a first portion of the exhaust stream and produce an oxygen enriched stream from the base of the lower pressure column and a nitrogen product stream from the overhead of the lower pressure column; and (vi) a turbine air stream column bypass circuit configured for directing a second portion of the exhaust stream to a waste stream drawn from the lower pressure column such that the second portion of the exhaust stream bypasses the distillation column system.

The distillation column system further includes an argon column arrangement operatively coupled with the lower pressure column, the argon column arrangement having at least one argon column and an argon condenser, and wherein the argon column arrangement is configured to receive an argon-oxygen enriched stream from the lower pressure column and to produce an oxygen enriched bottoms stream that is returned to or released into the lower pressure column and an argon-enriched overhead that is directed to the argon condenser. The argon condenser is configured to condense the argon-enriched overhead against all or a portion of the oxygen enriched stream from the lower pressure column to produce a crude argon stream or a product argon stream, an argon reflux stream and an oxygen enriched waste stream.

Alternatively, the present invention may be characterized as a method of separating air in a cryogenic air separation unit to produce one or more nitrogen products and a crude argon product comprising the steps of: (a) compressing an incoming feed air stream to produce a compressed air stream; (b) purifying the compressed air stream in an adsorption based pre-purifier unit configured for removing water vapor, carbon dioxide, nitrous oxide, and hydrocarbons from the compressed air stream to produce a compressed and purified air stream; (c) splitting the compressed and purified air stream into at least a first part of the compressed and purified air stream and a second part of the compressed and purified air stream; (d) cooling the first part of the compressed and purified air stream and the second part of the compressed and purified air stream in a main heat exchanger system; (e) expanding the cooled second part of the compressed and purified air stream in a turboexpander arrangement to form an exhaust stream; (f) directing a first portion of the exhaust stream and the cooled first part of the compressed and purified air stream to a distillation column system; (g) separating the first portion of the exhaust stream and the cooled first part of the compressed and purified air stream in the distillation column system to produce the oxygen enriched stream from the base of the lower pressure column and the nitrogen product stream from the overhead of the lower pressure column; (h) further separating an argon-oxygen enriched stream taken from the lower pressure column in an argon column arrangement to produce an oxygen enriched bottoms stream and an argon-enriched overhead; (i) directing the oxygen enriched bottoms stream into the lower pressure column; (j) directing the argon-enriched overhead to a condensing side of an argon condenser; (k) directing all or a portion of the oxygen enriched stream from the lower pressure column to a boiling side of the argon condenser; (l) condensing the argon-enriched overhead against the oxygen enriched stream from the lower pressure column to produce a crude argon stream and an argon reflux stream while boiling the first portion of the oxygen enriched stream and the liquid nitrogen to produce an oxygen enriched waste stream; and (m) directing a second portion of the exhaust stream to a waste stream drawn from the lower pressure column such that the second portion of the exhaust stream bypasses the distillation column system.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

The presently disclosed system and method provides for cryogenic separation of air in a moderate pressure air separation unit characterized by a very high recovery of nitrogen, a high recovery of argon, and limited production of high purity oxygen. As discussed in more detail below, either a portion of high purity oxygen enriched stream taken from the lower pressure column or a lower purity oxygen enriched stream taken from the lower pressure column is used as the condensing medium in the argon condenser to condense the argon-rich stream and the oxygen rich boil-off from the argon condenser is then used as a purge gas to regenerate the adsorbent beds in the adsorption based pre-purifier unit. Details of the present system and method are provided in the paragraphs that follow.

Figure 1:
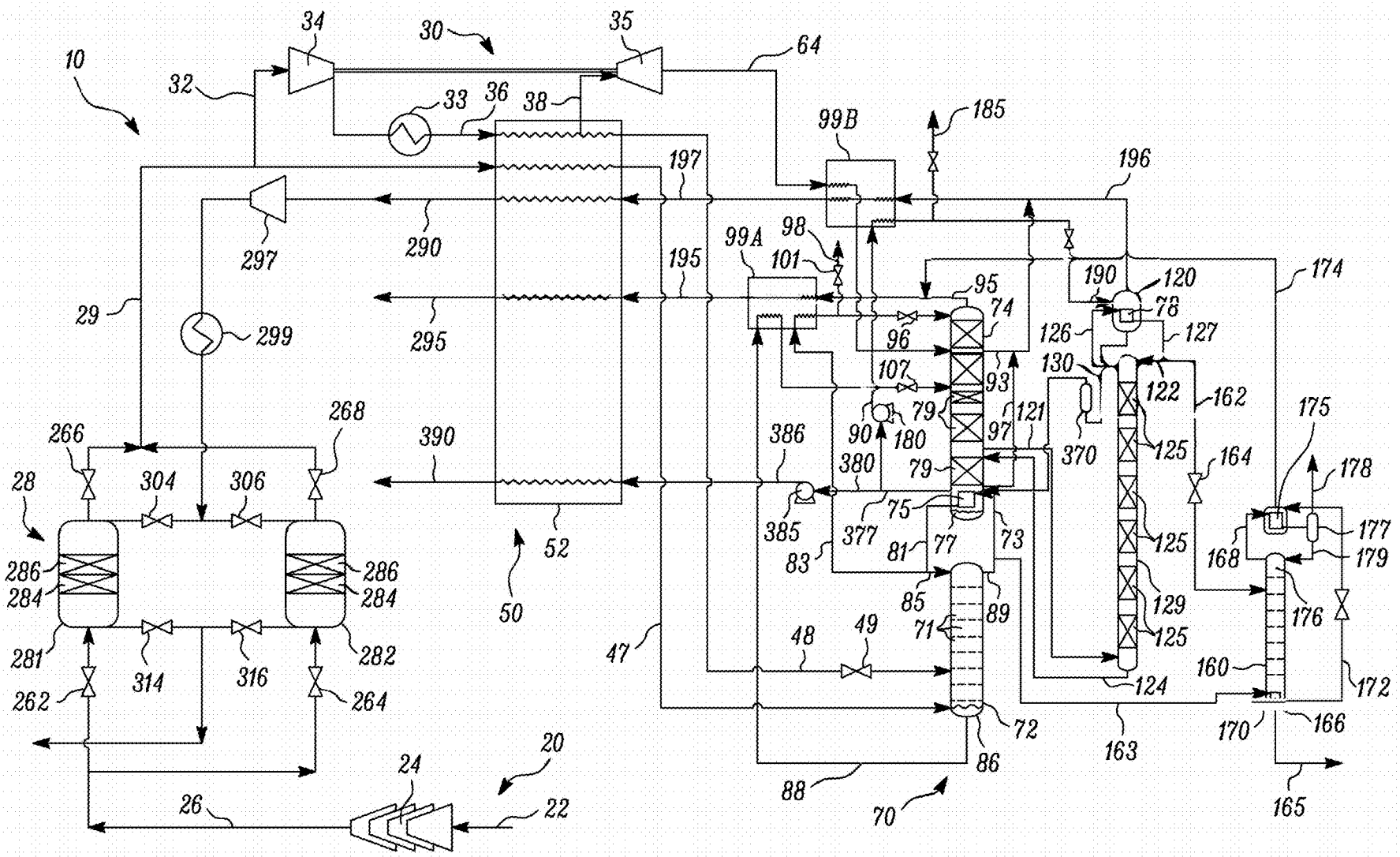
FIG. 1 is a schematic process flow diagram of a prior art nitrogen and argon producing, moderate pressure cryogenic air separation unit.

Recovery of $N_2$, Ar and $O_2$ in Normal Operating Modes of a Moderate Pressure ASU Turning to FIG. 1, there is shown simplified schematic illustrations of an air separation unit 10. As described in U.S. patent application Ser. Nos. 15/962,205; 15/962,245; and Ser. No. 15/962,297; the disclosures of which are incorporated by reference herein, the depicted moderate pressure, cryogenic air separation unit includes a main feed air compression train or system 20, a turbine air circuit 30, an optional booster air circuit 40, a primary heat exchanger system 50, and a distillation column system 70. As used herein, the main feed air compression train, the turbine air circuit, and the booster air circuit, collectively comprise the 'warm-end' air compression circuit. Similarly, main heat exchanger, portions of the turbine based refrigeration circuit and portions of distillation column system are referred to as 'cold-end' equipment that are typically housed in insulated cold boxes.

In the main feed compression train shown in FIG. 1, the incoming feed air 22 is typically drawn through an air suction filter house (ASFH) and is compressed in a multi-stage, intercooled main air compressor arrangement 24 to a pressure that can be between about 6.5 bar(a) and about 11 bar(a). This main air compressor arrangement 24 may include integrally geared compressor stages or a direct drive compressor stages, arranged in series or in parallel. The compressed air stream 26 exiting the main air compressor arrangement 24 is fed to an aftercooler with integral demister to remove the free moisture in the incoming feed air stream. The heat of compression from the final stages of compression for the main air compressor arrangement 24 is removed in aftercoolers by cooling the compressed feed air with cooling tower water. The condensate from this aftercooler as well as some of the intercoolers in the main air compression arrangement 24 is preferably piped to a condensate tank and used to supply water to other portions of the air separation plant.

The cool, dry compressed air stream 26 is then purified in a pre-purification unit 28 to remove high boiling contaminants from the cool, dry compressed air feed. A pre-purification unit 28, as is well known in the art, typically contains two beds of alumina and/or molecular sieve operating in accordance with a temperature swing adsorption cycle in which moisture and other impurities, such as carbon dioxide, water vapor and hydrocarbons, are adsorbed. While one of the beds is used for pre-purification of the cool, dry compressed air feed while the other bed is regenerated, preferably with a portion of the waste nitrogen from the air separation unit. The two beds switch service periodically. Particulates are removed from the compressed, pre-purified feed air in a dust filter disposed downstream of the pre-purification unit 28 to produce the compressed, purified air stream 29.

The compressed and purified air stream 29 is separated into oxygen-rich, nitrogen-rich, and argon-rich fractions in a plurality of distillation columns including a higher pressure column 72, a lower pressure column 74, and an argon column 129. Prior to such distillation however, the compressed and pre-purified air stream 29 is typically split into a plurality of feed air streams, which may include a boiler air stream and a turbine air stream 32. The boiler air stream may be further compressed in a booster compressor arrangement and subsequently cooled in aftercooler to form a boosted pressure air stream 360 which is then further cooled in the main heat exchanger 52. Cooling or partially cooling of the air streams in the main heat exchanger 52 is preferably accomplished by way of indirect heat exchange with the warming streams which include the oxygen streams 197, 386 as well as nitrogen streams 195 from the distillation column system 70 to produce cooled feed air streams.

The partially cooled feed air stream 38 is expanded in the turbine 35 to produce exhaust stream 64 that is directed to the lower pressure column 74. A portion of the refrigeration for the air separation unit 10 is also typically generated by the turbine 35. The fully cooled air stream 47 as well as the elevated pressure air stream are introduced into higher pressure column 72. Optionally, a minor portion of the air flowing in turbine air circuit 30 is not withdrawn in turbine feed stream 38. Optional boosted pressure stream 48 is withdrawn at the cold end of heat exchanger 52, fully or partially condensed, let down in pressure in valve 49 and fed to higher pressure column 72, several stages from the bottom. Stream 48 is utilized only when the magnitude of pumped oxygen stream 386 is sufficiently high.

The main heat exchanger 52 is preferably a brazed aluminum plate-fin type heat exchanger. Such heat exchangers are advantageous due to their compact design, high heat transfer rates and their ability to process multiple streams. They are manufactured as fully brazed and welded pressure vessels. For small air separation unit units, a heat exchanger comprising a single core may be sufficient. For larger air separation unit units handling higher flows, the heat exchanger may be constructed from several cores which must be connected in parallel or series.

The turbine based refrigeration circuits are often referred to as either a lower column turbine (LCT) arrangement or an upper column turbine (UCT) arrangement which are used to provide refrigeration to a two-column or three column cryogenic air distillation column systems. In the UCT arrangement shown in FIG. 1, the compressed, cooled turbine air stream 32 is preferably at a pressure in the range from between about 6 bar(a) to about 10.7 bar(a). The compressed, cooled turbine air stream 32 is directed or introduced into main or primary heat exchanger 52 in which it is partially cooled to a temperature in a range of between about 140 and about 220 Kelvin to form a partially cooled, compressed turbine air stream 38 that is introduced into a turbine 35 to produce a cold exhaust stream 64 that is then introduced into the lower pressure column 74 of the distillation column system 70. The supplemental refrigeration created by the expansion of the stream 38 is thus imparted directly to the lower pressure column 72 thereby alleviating some of the cooling duty of the main heat exchanger 52. In some embodiments, the turbine 35 may be coupled with booster compressor 34 that is used to further compress the turbine air stream 32, either directly or by appropriate gearing.

While the turbine based refrigeration circuit illustrated in the FIG. 1 is shown as an upper column turbine (UCT) circuit where the turbine exhaust stream is directed to the lower pressure column, it is contemplated that the turbine based refrigeration circuit alternatively may be a lower column turbine (LCT) circuit or a partial lower column (PLCT) where the expanded exhaust stream is fed to the higher pressure column 72 of the distillation column system 70. Still further, turbine based refrigeration circuits may be some variant or combination of LCT arrangement, UCT arrangement and/or a warm recycle turbine (WRT) arrangement, generally known to those persons skilled in the art.

The aforementioned components of the incoming feed air stream, namely oxygen, nitrogen, and argon are separated within the distillation column system 70 that includes a higher pressure column 72, a lower pressure column 74, an argon column 129, a condenser-reboiler 75 and an argon condenser 78. The higher pressure column 72 typically operates in the range from between about 6 bar(a) to about 10 bar(a) whereas lower pressure column 74 operates at pressures between about 1.5 bar(a) to about 2.8 bar(a). The higher pressure column 72 and the lower pressure column 74 are preferably linked in a heat transfer relationship such that all or a portion of the nitrogen-rich vapor column overhead, extracted from proximate the top of higher pressure column 72 as stream 73, is condensed within a condenser-reboiler 75 located in the base of lower pressure column 74 against the oxygen-rich liquid column bottoms 77 residing in the bottom of the lower pressure column 74. The boiling of oxygen-rich liquid column bottoms 77 initiates the formation of an ascending vapor phase within lower pressure column 74. The condensation produces a liquid nitrogen containing stream 81 that is divided into a clean shelf reflux stream 83 that may be used to reflux the lower pressure column 74 to initiate the formation of descending liquid phase in such lower pressure column 74 and a nitrogen-rich stream 85 that refluxes the higher pressure column 72.

Cooled feed air stream 47 is preferably a vapor air stream slightly above its dew point, although it may be at or slightly below its dew point, that is fed into the higher pressure column for rectification resulting from mass transfer between an ascending vapor phase and a descending liquid phase that is initiated by reflux stream 85 occurring within a plurality of mass transfer contacting elements, illustrated as trays 71. This produces crude liquid oxygen column bottoms 86, also known as kettle liquid which is taken as stream 88, and the nitrogen-rich column overhead 89, taken as clean shelf liquid stream 83.

In the lower pressure column, the ascending vapor phase includes the boil-off from the condenser-reboiler as well as the exhaust stream 64 from the turbine 35 which is subcooled in subcooling unit 99B and introduced as a vapor stream at an intermediate location of the lower pressure column 72. The descending liquid is initiated by nitrogen reflux stream 83, which is sent to subcooling unit 99A, where it is subcooled and subsequently expanded in valve 96 prior to introduction to the lower pressure column 74 at a location proximate the top of the lower pressure column. If needed, a small portion of the subcooled nitrogen reflux stream 83 may be taken via valve 101 as liquid nitrogen product 98.

Lower pressure column 74 is also provided with a plurality of mass transfer contacting elements, that can be trays or structured packing or other known elements in the art of cryogenic air separation. The contacting elements in the lower pressure column 74 are illustrated as structured packing 79. The separation occurring within lower pressure column 74 produces an oxygen-rich liquid column bottoms 77 extracted as an oxygen enriched liquid stream 377 having an oxygen concentration of greater than 99.5%. The lower pressure column further produces a nitrogen-rich vapor column overhead that is extracted as a gaseous nitrogen product stream 95.

Oxygen enriched liquid stream 377 can be separated into a first oxygen enriched liquid stream 380 that is pumped in pump 385 and the resulting pumped oxygen stream 386 is directed to the main heat exchanger 52 where it is warmed to produce a high purity gaseous oxygen product stream 390. A second portion of the oxygen enriched liquid stream 377 is diverted as second oxygen enriched liquid stream 90. The second oxygen enriched liquid stream 90 is preferably pumped via pump 180 then subcooled in subcooling unit 99B via indirect heat exchange with the oxygen enriched waste stream 196 and then passed to argon condenser 78 where it is used to condense the argon-rich stream 126 taken from the overhead 123 of the argon column 129. As shown in FIG. 1, a portion of the subcooled second oxygen enriched liquid stream 90 or a portion of the first liquid oxygen stream may be taken as liquid oxygen product. However, the extraction of liquid oxygen product 185 as shown in FIG. 1 adversely impacts operating efficiencies of and recovery of argon and nitrogen from the air separation plant.

The vaporized oxygen stream that is boiled off from the argon condenser 78 is an oxygen enriched waste stream 196 that is warmed within subcooler 99B. The warmed oxygen enriched waste stream 197 is directed to the main or primary heat exchanger and then used as a purge gas to regenerate the adsorption based prepurifier unit 28. Additionally, a waste nitrogen stream 93 may be extracted from the lower pressure column to control the purity of the gaseous nitrogen product stream 95. The waste nitrogen stream 93 is preferably combined with the oxygen enriched waste stream 196 upstream of subcooler 99B. Also, vapor waste oxygen stream 97 may be needed in some cases when more oxygen is available than is needed to operate argon condenser 78, typically when argon production is reduced.

Liquid stream 130 is withdrawn from argon condenser vessel 120, passed through gel trap 370 and returned to the base or near the base of lower pressure column 74. Gel trap 370 serves to remove carbon dioxide, nitrous oxide, and certain heavy hydrocarbons that might otherwise accumulate in the system. Alternatively, a small flow can be withdrawn via stream 130 as a drain from the system such that gel trap 140 is eliminated (not shown).

Preferably, the argon condenser shown in the Figs. is a downflow argon condenser. The downflow configuration makes the effective delta temperature ($\Delta T$) between the condensing stream and the boiling stream smaller. As indicated above, the smaller $\Delta T$ may result in reduced operating pressures within the argon column, lower pressure column, and higher pressure column, which translates to a reduction in power required to produce the various product streams as well as improved argon recovery. The use of the downflow argon condenser also enables a potential reduction in the number of column stages, particularly for the argon column. Use of an argon downflow condenser is also advantageous from a capital standpoint, in part, because pump 180 is already required in the presently disclosed air separation cycles. Also, since liquid stream 130 already provides a continuous liquid stream exiting the argon condenser shell which also provides the necessary wetting of the reboiling surfaces to prevent the argon condenser from 'boiling to dryness'.

Nitrogen product stream 95 is passed through subcooling unit 99A to subcool the nitrogen reflux stream 83 and kettle liquid stream 88 via indirect heat exchange. As indicated above, the subcooled nitrogen reflux stream 83 is expanded in valve 96 and introduced into an uppermost location of the lower pressure column 74 while the subcooled the kettle liquid stream 88 is expanded in valve 107 and introduced to an intermediate location of the lower pressure column 74. After passage through subcooling units 99A, the warmed nitrogen stream 195 is further warmed within main heat exchanger 52 to produce a warmed gaseous nitrogen product stream 295.

The flow of the first oxygen enriched liquid stream 380 may be up to about 20% of the total oxygen enriched streams exiting the system. The argon recovery of this arrangement is between about 75% and 96% which is greater than the prior art moderate pressure air separation systems. Although not shown, a stream of liquid nitrogen taken from an external source (not shown) may be combined with the second oxygen enriched liquid stream 90 and the combined stream used to condense the argon-rich stream 126 in the argon condenser 78, to enhance the argon recovery.

Recovery of Nitrogen, Argon, and Oxygen in Off-Design Operating Modes

The air separation cycles disclosed in U.S. patent application Ser. Nos. 15/962,205; 15/962,245; and 15/962,297 and discussed above with reference to FIG. 1 are ideal for producing nitrogen and argon at very high gas recoveries. In normal operating modes, there is no need for waste nitrogen to be drawn from the lower pressure column which can yield an effective nitrogen recovery of at or near 100%. However, in some off design operating modes such as low argon mode, high liquid make mode, startup mode, etc., the cryogenic air separation unit of FIG. 1 might require a nitrogen waste draw to maintain the nitrogen purity taken from the top of the lower pressure column. In addition, a nitrogen waste draw may be taken from lower pressure column from time to time due to underperformance of the cryogenic air separation unit or due to changes or an increase in product requirements associated with nitrogen product purity. Pulling waste nitrogen from the lower pressure column has the effect of improving the liquid to vapor flow ratio (L/V) in the top or upper sections of the lower pressure column, thus improving the nitrogen purity of the nitrogen taken from the tophat or top of the lower pressure column and ensuring the purity of the nitrogen product is within the product specifications.

Figure 2:
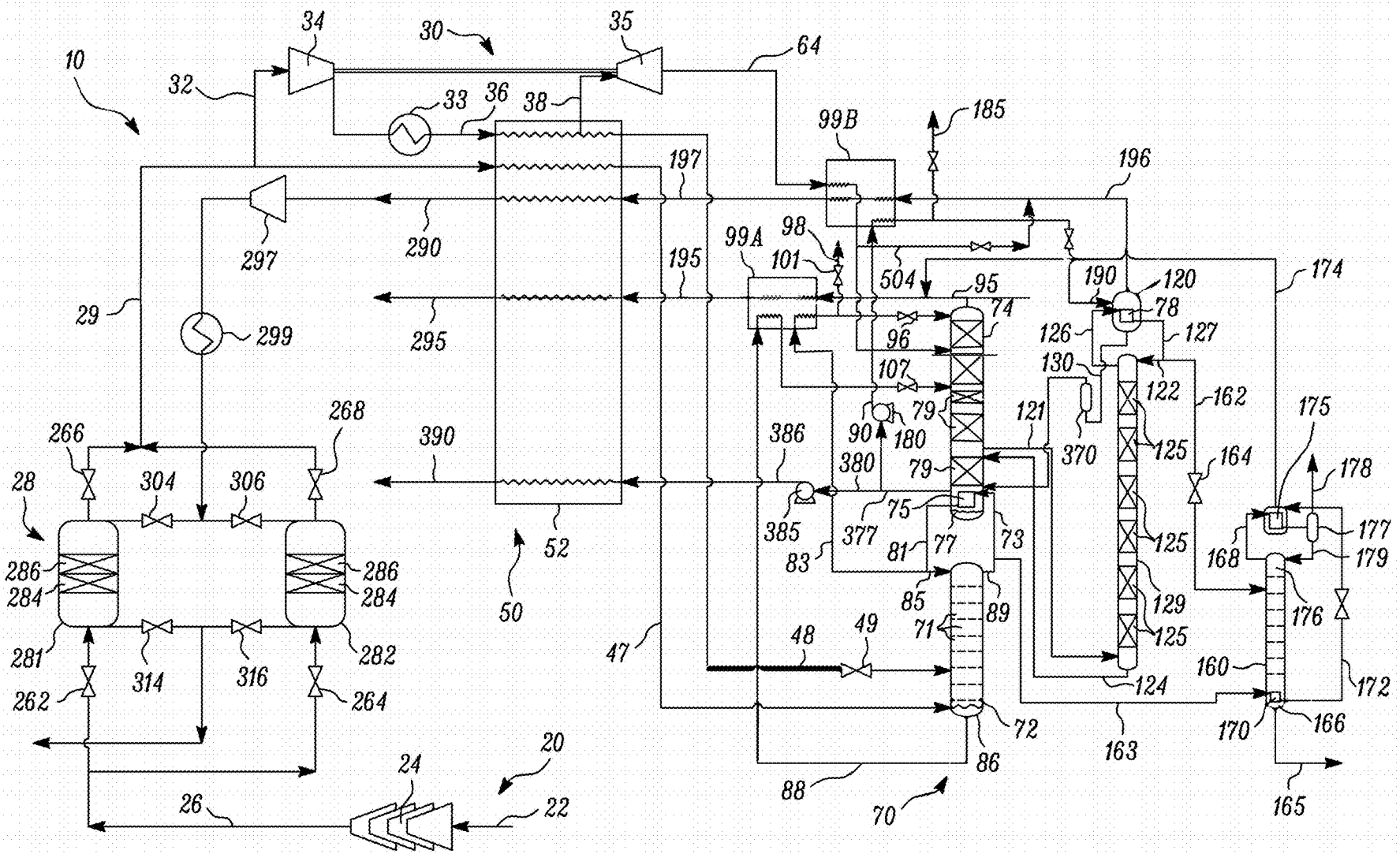
FIG. 2 is a schematic process flow diagram of a nitrogen and argon producing, moderate pressure cryogenic air separation unit in accordance with an embodiment of the present invention.

An embodiment of the present nitrogen and argon producing, moderate pressure cryogenic air separation unit in shown in FIG. 2. Many of the components in the air separation plant shown in FIG. 2 are similar or identical to those described above with reference to FIG. 1 and for sake of brevity will not be repeated. The differences between the embodiment of FIG. 2 compared to the embodiment shown in FIG. 1 is the addition of a column bypass circuit. As seen therein, the turbine air bypass arrangement comprising a diverted portion 504 of the cooled turbine air stream that bypasses the lower pressure column via valve in FIG. 2 is a functional alternative to the conventional waste nitrogen draw line 93 from the lower pressure column 74 of FIG. 1.

Choosing the optimum location for the nitrogen waste draw from the lower pressure column in any nitrogen and argon producing, moderate pressure cryogenic air separation units requires a tradeoff between nitrogen recoveries and argon recoveries. For example, on the one hand, if the nitrogen waste draw location is vertically higher up the lower pressure column, the argon recovery is highest. However, the nitrogen waste flow from the vertically higher locations may need to be greater to ensure meeting the tophat nitrogen purity requirements, which imparts a negative effect on nitrogen recovery. On the other hand, if the nitrogen waste draw is at a vertically lower location on the lower pressure column, the argon concentration in the waste draw will be relatively higher and may have a negative effect on the argon recovery. In column configurations where the nitrogen waste draw is at a vertically lower location on the lower pressure column, the nitrogen recovery may be higher since the total nitrogen waste draw flow needed to meet the nitrogen product purity requirements decreases compared to the nitrogen waste draw flow needed at vertically higher waste draw locations.

Simulations of the cryogenic air separation units disclosed in U.S. patent application Ser. Nos. 15/962,205; 15/962,245; 15/962,297 and FIG. 1 have shown that an optimum nitrogen waste draw location is at or near the same location as the turbine air stream 64 feed to the lower pressure column 74 and/or the kettle liquid 88 feed to the lower pressure column 74.

It has been realized that because an ideal location of the nitrogen waste draw in these nitrogen and argon producing, moderate pressure cryogenic air separation units is at or near the same location as the turbine air stream 64 feed to the lower pressure column 74, pulling a nitrogen waste flow has the same effect on the L/V ratio as diverting a part, or more accurately a second portion 504 of the cooled turbine air stream directly to the waste circuit via valve and bypassing the distillation column system. This bypass stream is referred to as the turbine air column bypass stream 504. The remainder of the turbine air stream or more accurately, the first portion of the turbine air stream is fed into the distillation column system, preferably at an intermediate location of the lower pressure column 74.

Figure 3:
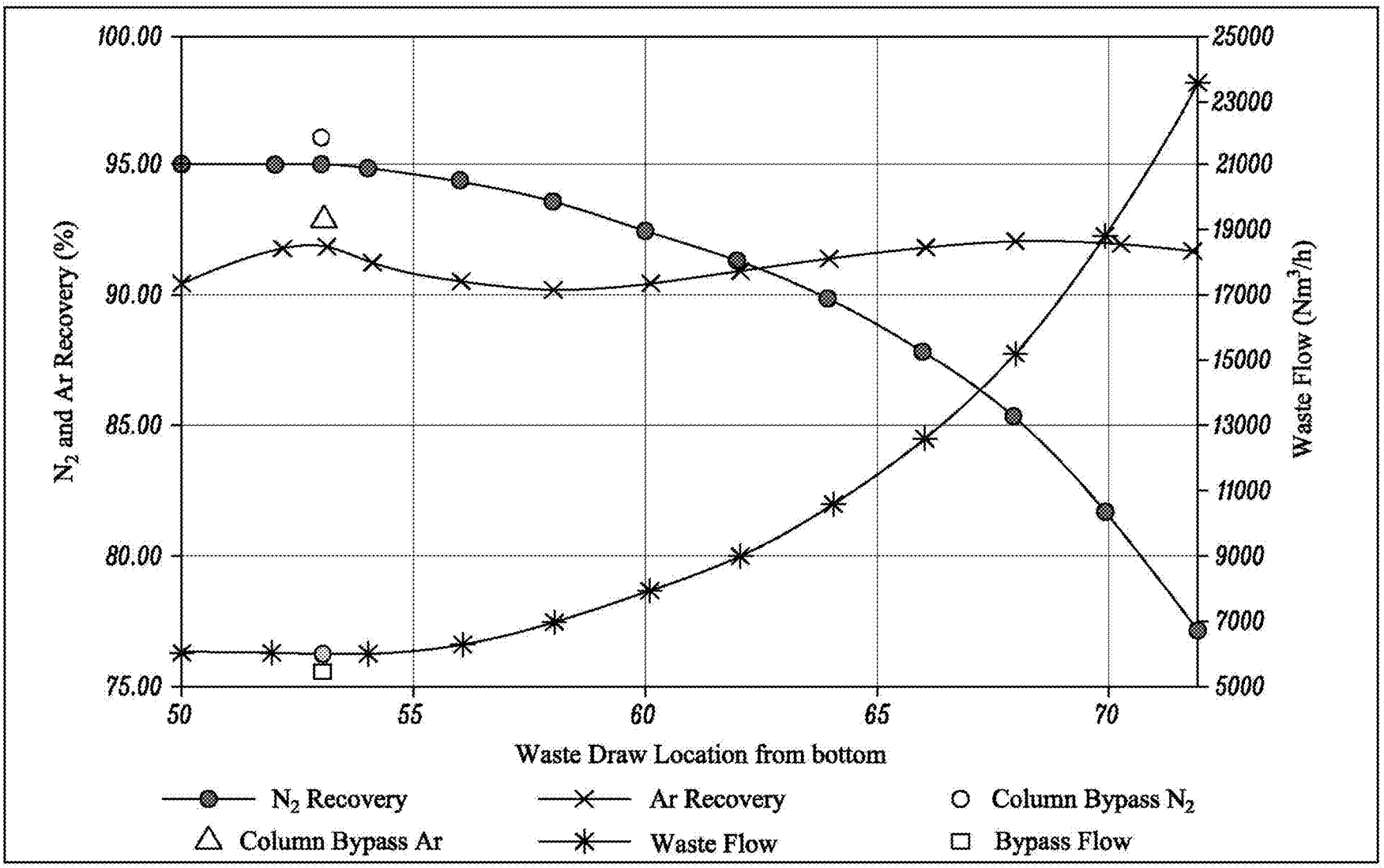
FIG. 3 is a graph depicting nitrogen and argon recovery in the nitrogen and argon producing, moderate pressure cryogenic air separation unit as a function of the location of a nitrogen waste draw in the lower pressure column and when employing the turbine air bypass arrangement in accordance with the present invention.

FIG. 3 shows a graph depicting nitrogen and argon recovery in the nitrogen and argon producing, moderate pressure cryogenic air separation unit as a function of the location of a nitrogen waste draw in the lower pressure column compared to embodiments employing the present turbine air bypass arrangement. As seen therein, the nitrogen and argon recoveries are slightly improved when diverting a portion of the turbine air stream directly to the waste nitrogen circuit and bypassing the lower pressure column compared to extracting similar volume of a waste draw from the lower pressure column.

The reason the turbine air column bypass arrangement represents an improvement over the conventional pulling of a nitrogen waste draw from the lower pressure column is twofold. First, the lower pressure column design is less complex and presumably at a lower capital cost if no nitrogen waste draw from the lower pressure column is required. Instead of there being a turbine air stream vapor feed, a kettle liquid feed, and a nitrogen waste vapor draw from the lower pressure column as in the prior art columns, the present system and method only require a turbine air stream vapor feed and a kettle liquid feed.

The second reason is improved gas recoveries. The turbine air column bypass stream has roughly 21% oxygen concentration and about 0.9% argon concentration. This turbine air column bypass stream therefore is generally higher in oxygen concentration and lower in argon concentration than a nitrogen waste draw from the lower pressure column taken at the same location, which is typically about 15% oxygen concentration and 1.2% argon concentration. The increased oxygen concentration of the turbine air column bypass stream compared to the nitrogen waste draw from the lower pressure column taken at the same location results in higher recovery of nitrogen. Also, the decreased argon concentration of the turbine air column bypass stream compared to the nitrogen waste draw from the lower pressure column taken at the same location results in higher recovery of argon.

While the present invention has been described with reference to a preferred embodiment or embodiments, it is understood that numerous additions, changes and omissions can be made without departing from the spirit and scope of the present invention as set forth in the appended claims.

What is claimed is:

1. A nitrogen and argon producing cryogenic air separation unit comprising:

a main air compression system configured to receive an incoming feed air stream and produce a compressed air stream;

an adsorption based pre-purifier unit configured for removing water vapor, carbon dioxide, nitrous oxide, and hydrocarbons from the compressed air stream and produce a compressed and purified air stream, wherein the compressed and purified air stream is split into at least a first part of the compressed and purified air stream and a second part of the compressed and purified air stream;

a main heat exchange system configured to cool the first part of the compressed and purified air stream and to partially cool the second part of the compressed and purified air stream;

a turboexpander arrangement configured to expand the partially cooled second part of the compressed and purified air stream to form an exhaust stream; and a distillation column system having a higher pressure column and a lower pressure column linked in a heat transfer relationship via a condenser-reboiler and configured to separate the cooled first part of the compressed and purified air stream and a first portion of the exhaust stream and produce an oxygen enriched stream from the base of the lower pressure column and a nitrogen product stream from the overhead of the lower pressure column;

the distillation column system further includes an argon column arrangement operatively coupled with the lower pressure column, the argon column arrangement having at least one argon column and an argon condenser, and wherein the argon column arrangement is configured to receive an argon-oxygen enriched stream from the lower pressure column and to produce an oxygen enriched bottoms stream that is returned to or released into the lower pressure column and an argon-enriched overhead that is directed to the argon condenser;

wherein the argon condenser is configured to condense the argon-enriched overhead against all or a portion of the oxygen enriched stream from the lower pressure column to produce a crude argon stream or a product argon stream, an argon reflux stream and an oxygen enriched waste stream; and a turbine air stream column bypass circuit configured for combining a second portion of the exhaust stream with the oxygen enriched waste stream such that the second portion of the exhaust stream bypasses the distillation column system.

2. The nitrogen and argon producing cryogenic air separation unit of claim 1, wherein the cryogenic air separation unit has a nitrogen recovery of 95 percent or greater of the nitrogen contained in the compressed air stream and an argon recovery of 92 percent or greater of the argon contained in the compressed air stream.

3. The nitrogen and argon producing cryogenic air separation unit of claim 1 wherein the argon condenser is configured to condense the argon-enriched overhead with a first portion of the oxygen enriched stream from the lower pressure column and wherein a second portion of the oxygen enriched stream from the lower pressure column is taken as an oxygen product stream.

4. The nitrogen and argon producing cryogenic air separation unit of claim 1, wherein the higher pressure column is configured to operate at an operating pressure between about 6.0 bar(a) and 10.0 bar(a), the lower pressure column is configured to operate at an operating pressure between about 1.5 bar(a) and 2.8 bar(a), and the argon column is configured to operate at a pressure of between about 1.3 bar(a) and 2.8 bar(a).

5. The nitrogen and argon producing cryogenic air separation unit of claim 4, wherein the argon column in the argon column arrangement is a superstaged column having between 180 and 260 stages of separation or an ultra-superstaged column having between 185 and 270 stages of separation.

6. The nitrogen and argon producing cryogenic air separation unit of claim 4 wherein the argon column arrangement further comprises a first argon column configured as a superstaged argon column, a second argon column configured as a high ratio argon column.

7. The nitrogen and argon producing cryogenic air separation unit of claim 1, wherein the adsorption based prepurifier unit is a multi-bed temperature swing adsorption unit configured for purifying the compressed air stream, the multi-bed temperature swing adsorption unit is further configured such that each bed alternates between an on-line operating phase adsorbing the water vapor, carbon dioxide, nitrous oxide, and hydrocarbons from the compressed air stream and an off-line operating phase where the bed is being regenerated with a purge gas taken from the combined oxygen enriched waste stream and the second portion of the exhaust stream.

8. The nitrogen and argon producing cryogenic air separation unit of claim 7, further comprising a regeneration blower configured to raise the pressure of the combined oxygen enriched waste stream and the second portion of the exhaust stream by about 0.1 bar(a) to 0.3 bar(a).

* * * * *